US009320354B2

(12) United States Patent
Yoshikawa

(10) Patent No.: US 9,320,354 B2
(45) Date of Patent: Apr. 26, 2016

(54) SHOE STORAGE APPARATUS

(71) Applicant: Toshiyuki Yoshikawa, Nara-ken (JP)

(72) Inventor: Toshiyuki Yoshikawa, Nara-ken (JP)

(73) Assignee: KABUSHIKI KAISHA YOSHIKAWAKUNI KOGYOSHO, Nara-ken (JP)

( * ) Notice: Subject to any disclaimer, the term of this patent is extended or adjusted under 35 U.S.C. 154(b) by 0 days.

(21) Appl. No.: 14/566,231

(22) Filed: Dec. 10, 2014

(65) Prior Publication Data

US 2015/0289645 A1 Oct. 15, 2015

(30) Foreign Application Priority Data

Apr. 14, 2014 (JP) ..... 2014-083034

(51) Int. Cl.

| | |
|---|---|
| ***A47F 7/08*** | (2006.01) |
| ***A47B 61/04*** | (2006.01) |
| ***A47B 61/00*** | (2006.01) |
| ***A47B 47/00*** | (2006.01) |

(52) U.S. Cl.

CPC ..... *A47B 61/04* (2013.01); *A47B 47/0075* (2013.01); *A47B 61/003* (2013.01)

(58) Field of Classification Search

CPC ..... A47F 7/08; A47F 61/04

See application file for complete search history.

(56) References Cited

U.S. PATENT DOCUMENTS 840,512 A * 1/1907 Palmer ..... A47G 25/0685 211/104
1,456,446 A * 5/1923 Hotaling ..... A47F 7/148 211/181.1
1,944,649 A * 1/1934 Smith, Sr. ..... A47F 7/08 211/150
2,195,919 A * 4/1940 Crilly ..... A47B 61/04 211/106
2,409,268 A * 10/1946 Gerlich ..... A47L 23/20 211/35
2,452,689 A * 11/1948 Sheppard ..... A43D 3/1433 12/115.6
2,682,955 A * 7/1954 Moore ..... A43D 117/00 211/104
2,790,555 A * 4/1957 Horchner ..... A43D 117/00 12/123
3,192,970 A * 7/1965 Scott ..... F16N 33/00 141/106
3,788,241 A * 1/1974 Ravreby ..... A47F 7/08 108/158.12
3,999,734 A * 12/1976 Gibson ..... A47F 7/142 211/2
4,200,993 A * 5/1980 Blanc ..... A47L 23/205 211/34

(Continued)

FOREIGN PATENT DOCUMENTS

CN 102008202 A 4/2011
JP 3099261 11/2003

(Continued)

OTHER PUBLICATIONS

Official Action issued on Sep. 22, 2015 in connection with corresponding Taiwanese Patent Application No. 103143878. 5 pages.

(Continued)

*Primary Examiner* — Joshua Rodden
*Assistant Examiner* — Kimberley S Wright
(74) *Attorney, Agent, or Firm* — Vedder Price P.C.

(57) ABSTRACT

The invention provides a shoe storage apparatus capable of saving space when stored, wherein a shoe storage apparatus includes a leg to be disposed on an installation surface, and an upper panel which has a base end portion to be supported by the leg and a tip end portion on the side opposite to the base end portion, and is disposed at a distance from the installation surface in a state where the base end portion is supported by the leg, and on which one shoe of a pair of shoes can be placed, and the upper panel is constituted to be detachable from the leg.

4 Claims, 5 Drawing Sheets

(56) References Cited

U.S. PATENT DOCUMENTS 4,289,243 A * 9/1981 Arbuzoff ..... A47L 23/20 211/100
4,512,480 A * 4/1985 Evenson ..... B42F 17/12 108/60
4,592,471 A * 6/1986 Bross ..... A47J 47/16 108/61
4,688,681 A * 8/1987 Bergeron ..... A47F 7/08 211/150
5,588,543 A * 12/1996 Finger ..... A47F 5/083 211/106
5,778,556 A * 7/1998 Ohsugi ..... A43D 3/1408 211/34
5,833,083 A * 11/1998 Miller ..... D06F 57/00 211/134
5,960,965 A * 10/1999 Saunders ..... A47F 5/0846 211/35
5,992,648 A * 11/1999 Saunders ..... A47F 5/0846 211/35
6,164,465 A * 12/2000 Schroeder ..... A47B 43/00 211/149
6,189,706 B1 * 2/2001 Akins ..... A47B 81/00 211/106
6,227,384 B1 * 5/2001 Saylor ..... A47B 17/033 211/11
6,464,087 B1 * 10/2002 Klein ..... A47B 96/16 211/113
6,581,786 B1 * 6/2003 King ..... A47F 7/08 211/119
7,963,404 B2 * 6/2011 Shang ..... A47B 47/0033 211/181.1
8,584,601 B1 * 11/2013 Deschner ..... B25H 1/04 108/134
2005/0224531 A1 * 10/2005 Bulovic ..... A47G 25/0657 223/85
2009/0211993 A1 * 8/2009 Chiang ..... A47F 7/08 211/37
2011/0174749 A1 * 7/2011 Chen ..... A47F 7/08 211/38
2015/0136715 A1 * 5/2015 Tremblay ..... A47B 61/04 211/36

FOREIGN PATENT DOCUMENTS

JP 3155850 11/2009
JP 3184535 6/2013

OTHER PUBLICATIONS

Second Official Action issued on Nov. 13, 2015 in connection with corresponding Taiwanese Patent Application No. 103143878. 6 pages, with English translation.

* cited by examiner

SHOE STORAGE APPARATUS

BACKGROUND OF THE INVENTION

1. Field of the Invention

The present invention relates to a shoe storage apparatus for storing shoes.

2. Description of the Related Art

Conventionally, a shoe storage apparatus for realizing effective utilization of a space for storing shoes is provided (for example, refer to Patent Document 1).

This type of shoe storage apparatus includes a lower panel on which one shoe of a pair of shoes is placed, an upper panel which is disposed above the lower panel and on which the other shoe of the pair of shoes is placed, and a leg that joins the lower panel and the upper panel.

According to this type of shoe storage apparatus, one shoe placed on the lower panel and the other shoe placed on the upper panel are arranged in the vertical direction. Accordingly, this type of shoe storage apparatus is capable of effectively utilizing a space in the vertical direction as compared with the case where a pair of shoes are arranged laterally side-by-side.

Patent Document 1: Japanese Utility Model Registration No. 3099261

In this type of shoe storage apparatus, there is an upper panel extending above an installation surface, so that the shoe storage apparatus needlessly occupies space, when not in use.

SUMMARY OF THE INVENTION

Therefore, in view of these circumstances, an object of the present invention is to provide a shoe storage apparatus capable of saving space when stored.

A shoe storage apparatus according to the present invention includes a leg that is disposed on an installation surface, and an upper panel which has a base end portion to be supported by the leg and a tip end portion on the side opposite to the base end portion and which is disposed at a distance from the installation surface in a state where the base end portion is supported by the leg and capable of placing one shoe of a pair of shoes thereon, wherein the upper panel is constituted to be detachable from the leg.

With this constitution, when storing a pair of shoes, either one shoe of a pair of shoes is placed on the upper panel, the other shoe of the pair of shoes is disposed below the upper panel, so that the left and right shoes of the pair of shoes can be disposed one above the other and stored. Therefore, when storing a pair of shoes, the shoe storage apparatus constituted as described above can more effectively utilize the space in the vertical direction than in the case where the pair of shoes are arranged laterally side by side and stored.

In addition, in the shoe storage apparatus described above, the upper panel is constituted to be detachable from the leg, so that the upper panel and the leg can be separated from each other when the shoe storage apparatus is not used. Therefore, in the shoe storage apparatus described above, when not in use, the upper panel does not extend from the leg, so that it does not needlessly occupy space. Accordingly, occupied space of the shoe storage apparatus described above when not in use (when stored) can be reduced.

As an aspect of the shoe storage apparatus according to the present invention, the leg may include a plurality of pairs of upper panel support portions each of which can support the base end portion of the upper panel, and the plurality of pairs of upper panel support portions may be arranged in parallel vertically.

With this constitution, the base end portion of the upper panel is supported by any pair of the plurality of pairs of upper panel support portions, and thereby the upper panel can be disposed at a position corresponding to the height of the shoes. Accordingly, the shoe storage apparatus can store not only shoes with a specific height but also shoes with various heights.

As another aspect of the shoe storage apparatus according to the present invention, preferably, the plurality of pairs of upper panel support portions are constituted so that each pair of upper panel support portions can support the base end portion of the upper panel in such a manner that the upper panel inclines upward from the base end portion toward the tip end portion, and the inclination angle of the upper panel is made larger by supporting the base end portion of the upper panel by a pair of upper panel support portions located at positions higher than a pair of upper panel support portions located at lower positions.

With this constitution, the upper panel is supported by a pair of upper panel support portions located at higher positions, and thereby the upper panel inclines at a larger inclination angle (an angle with respect to the installation surface) than in the case where the upper panel is supported by a pair of upper panel support portions located at lower positions. Accordingly, the tip end portion side of the upper panel is positioned to be higher than the base end portion, so that the space below the tip end portion of the upper panel can be enlarged. Therefore, even high-heeled shoes and high-cut shoes can also be disposed not only on the upper panel but also below the upper panel.

As another aspect of the shoe storage apparatus according to the present invention, the shoe storage apparatus may further include a lower panel that has a base end portion to be supported by the leg and a tip end portion on the side opposite to the base end portion, and is disposed along an installation surface in the state where the base end portion is supported by the leg, and the lower panel may be constituted to be detachable from the leg.

With this constitution, either one shoe of a pair of shoes is placed on the upper panel and then the other shoe of the pair of shoes is placed on the lower panel, so that the pair of shoes can be stored by storing the shoe storage apparatus. Thus, the shoes can be stored more easily. Even if dirt adheres to the sole of the shoe, the dirt on the sole of the shoe can be prevented from adhering to an installation surface (for example, an installation surface inside a shoe box) by disposing a shoe on the lower panel.

As another aspect of the shoe storage apparatus according to the present invention, the leg may include a pair of lower panel support portions capable of supporting the base end port ion of the lower panel.

With this constitution, the lower panel is appropriately attached to a position along the installation surface by supporting the lower panel by the pair of lower panel support portions.

As another aspect of the shoe storage apparatus according to the present invention, the upper panel may have a projecting piece-shaped upper supported portion on the base end portion, and the leg may have, at positions corresponding to the pairs of upper panel support portions, upper attaching portions into which the upper supported portion can be inserted and which can prevent the upper supported portion from coming off.

With this constitution, the upper panel is latched on the inner surface of the upper attaching portion by its own weight by inserting the upper supported portion into the upper attaching portion. Accordingly, the upper panel is prevented from coming off by the upper attaching portion, so that the upper panel can be prevented from unexpectedly falling off the leg.

As another aspect of the shoe storage apparatus according to the present invention, the lower panel may have a projecting piece-shaped lower supported portion on the base end portion, and the leg may have, at a position corresponding to the pair of lower panel support portions, a lower attaching portion into which the lower supported portion can be inserted and which can prevent the lower supported portion from coming off.

With this constitution, the lower panel is latched on the inner surface of the lower attaching portion by its own weight by inserting the lower supported portion into the lower attaching portion. Accordingly, the lower panel is prevented from coming off by the lower attaching portion, so that the lower panel can be prevented from unexpectedly falling off the leg.

As described above, the shoe storage apparatus according to the present invention brings about an excellent effect to allow space-saving even when the shoe storage apparatus is stored.

DETAILED DESCRIPTION OF THE PREFERRED EMBODIMENT

An embodiment of the shoe storage apparatus according to the present invention is described with reference to FIG. 1 to FIG. 5.

Figure 1:
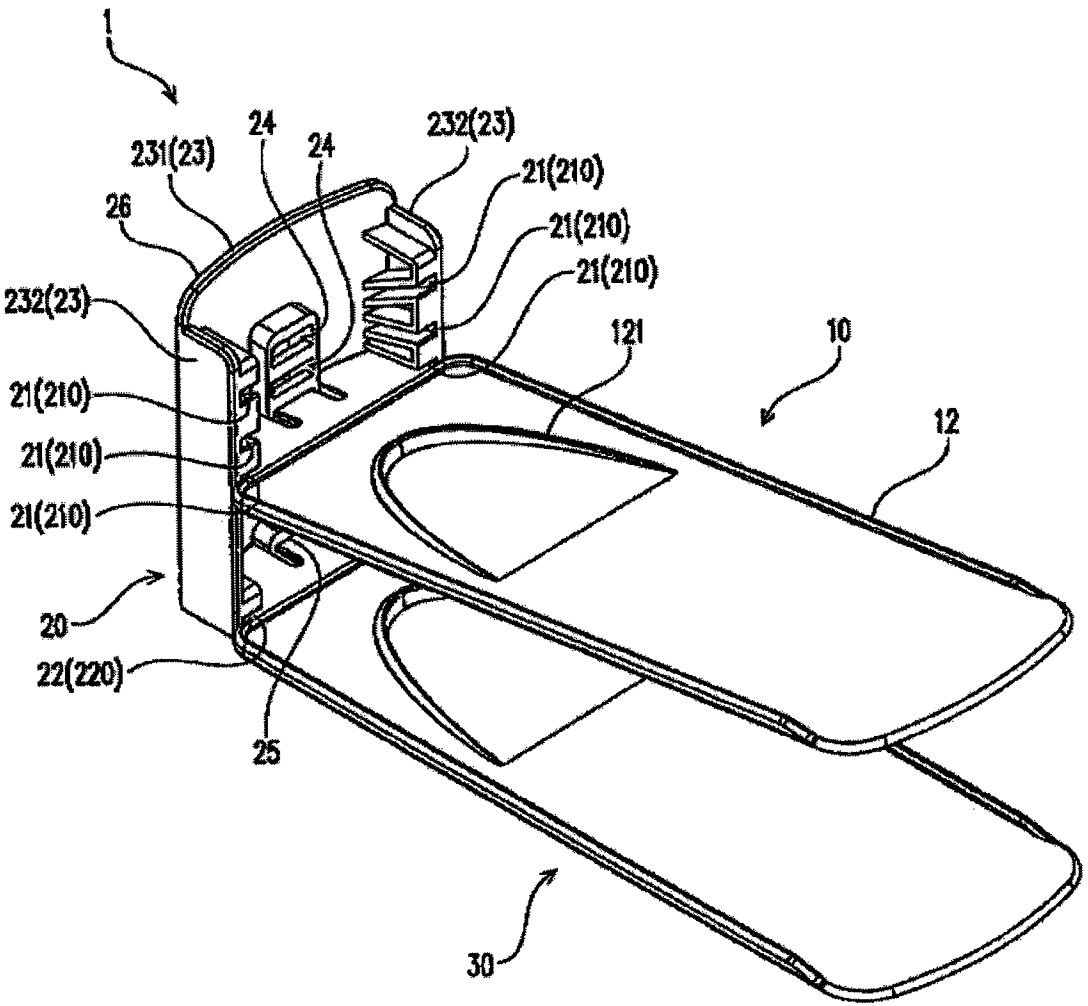
FIG. 1 is a schematic perspective view of a shoe storage apparatus according to an embodiment of the present invention, showing the shoe storage apparatus in a state where an upper panel and a lower panel are attached to a leg.
Figure 2:
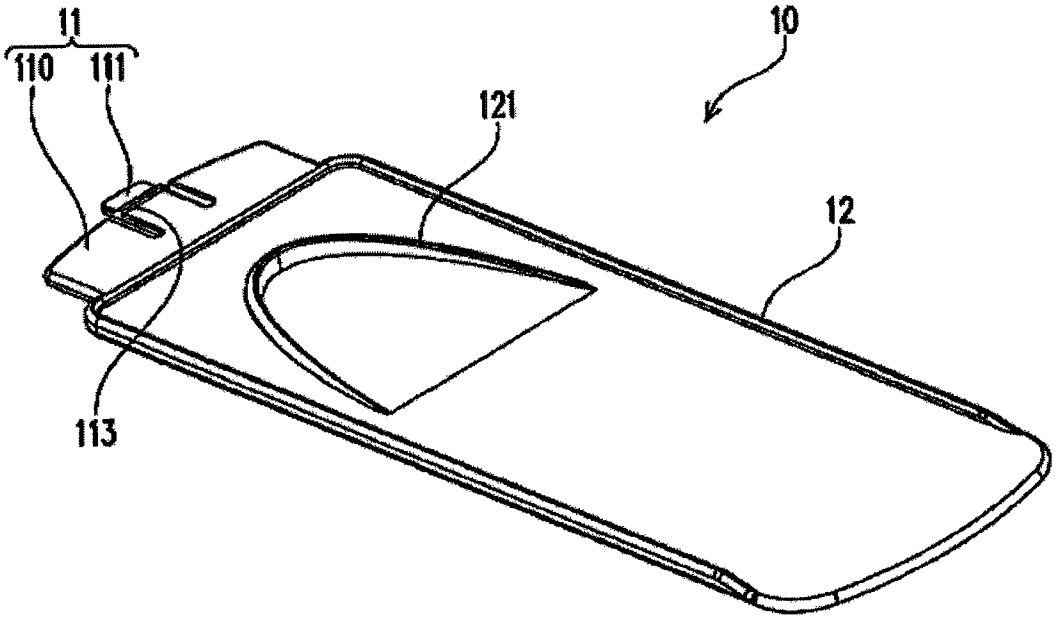
FIG. 2 is a schematic perspective view of the upper panel according to the same embodiment.

As shown in FIG. 1 and FIG. 2, the shoe storage apparatus 1 according to the present embodiment includes a leg 20 that is disposed on an installation surface, and an upper panel 10 which has a base end portion to be supported by the leg 20 and a tip end portion on the side opposite to the base end portion, and is disposed at a distance from the installation surface in a state where the base end portion is supported by the leg 20, and on which one shoe of a pair of shoes can be placed. The shoe storage apparatus 1 according to the present embodiment further includes a lower panel 30 that has a base end portion to be supported by the leg 20 and a tip end portion on the side opposite to the base end portion, and is disposed along the installation surface in a state where the base end portion is supported by the leg 20. Here, the upper panel 10 is constituted to be detachable from the leg 20. The lower panel 30 is constituted to be detachable from the leg 20.

Figure 4:
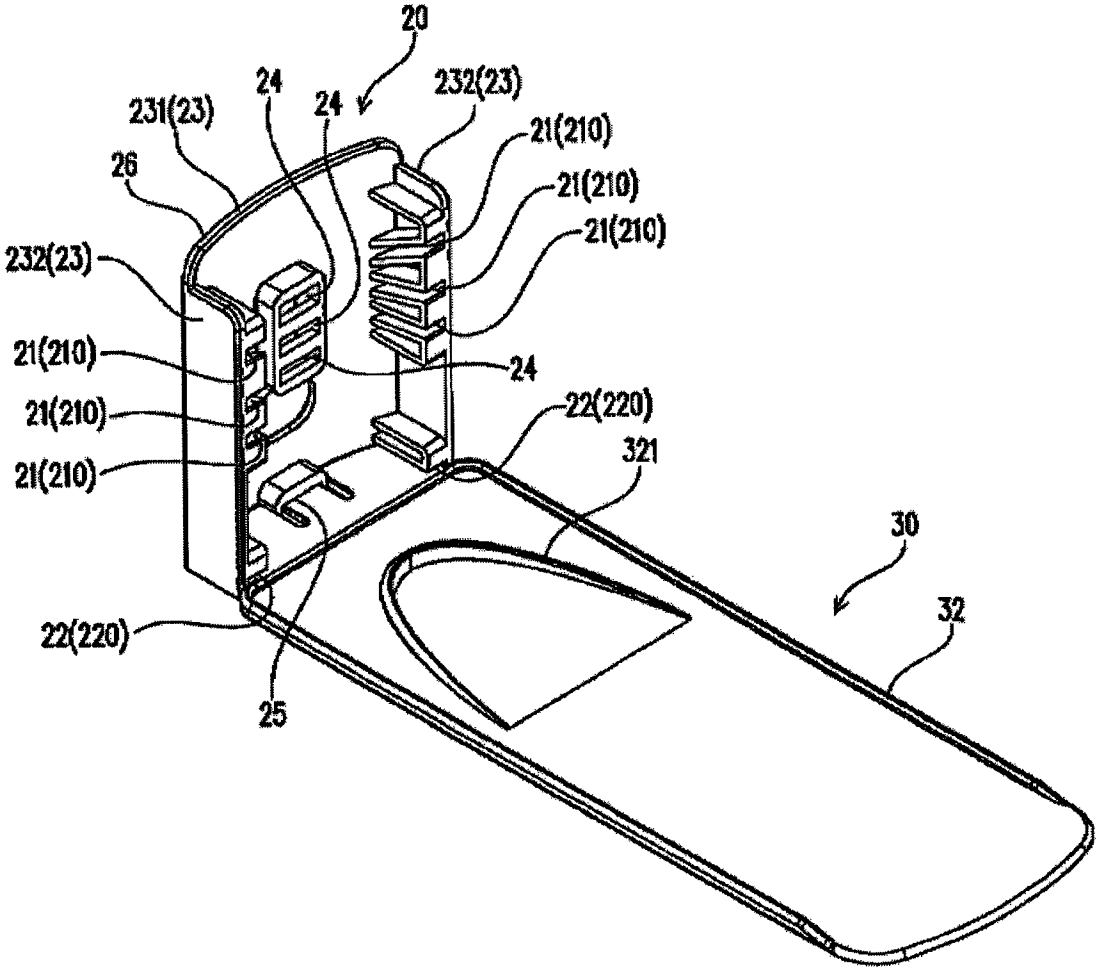
FIG. 4 is a schematic perspective view of the shoe storage apparatus according to the same embodiment, showing the shoe storage apparatus in a state where the lower panel is attached to the leg.

As shown in FIG. 1 and FIG. 4, the leg 20 includes a leg body 26 that is made to stand, and upper attaching portions 24 into which an upper supported portion 11 can be inserted, and which prevent the upper supported portion 11 from coming off. The leg 20 includes a plurality of pairs of upper panel support portions 21 each of which can support the base end port ion of the upper panel 10. Further, the leg 20 has, at positions corresponding to the pairs of upper panel support portions 21, upper attaching portions 24 into which the upper panel 10 can be inserted and which can prevent the upper panel 10 from coming off. Further, the leg 20 has, at a position corresponding to the pair of lower panel support portions 22, a lower attaching portion 25 into which the lower panel 30 can be inserted and which can prevent the lower panel 30 from coming off.

The leg body 26 has, as shown in FIG. 1 and FIG. 4, an installation portion (not shown) to be installed on the installation surface, and a standing portion 23 standing along the outer periphery of the installation portion.

The installation portion is provided as a portion to be installed in a state where either one shoe of a pair of shoes is placed on the upper panel 10. Therefore, a lower surface of the installation portion is formed in a flat surface. In the present embodiment, the installation portion is formed in a flat plate shape, and has one side formed in an arc shape.

The standing portion 23 is formed to stand along one side formed in an arc shape of the installation portion and the outer peripheries of both sides continuous to the one side. Specifically, the standing portion 23 has a first standing portion 231 that stands from one side formed into an arc shape of the installation portion, and second standing portions 232 and 232 continuous to each of both ends in the width direction of the first standing portion 231.

The first standing portion 231 is formed as a plate body curved so as to have the same shape as the one side formed in an arc shape of the installation portion. The first standing portion 231 is connected to the upper attaching portions 24 and the lower attaching portion 25 by the surface continuous to the upper surface of the installation portion. Therefore, the first standing portion 231 is made to stand from the installation portion so as to have a height higher than the installation heights of the upper attaching portions 24.

The second standing portions 232 and 232 are formed of plate bodies, and are connected to the upper panel support portions 21 and the lower panel support portions 22 by their surfaces opposed to each other.

Figure 5:
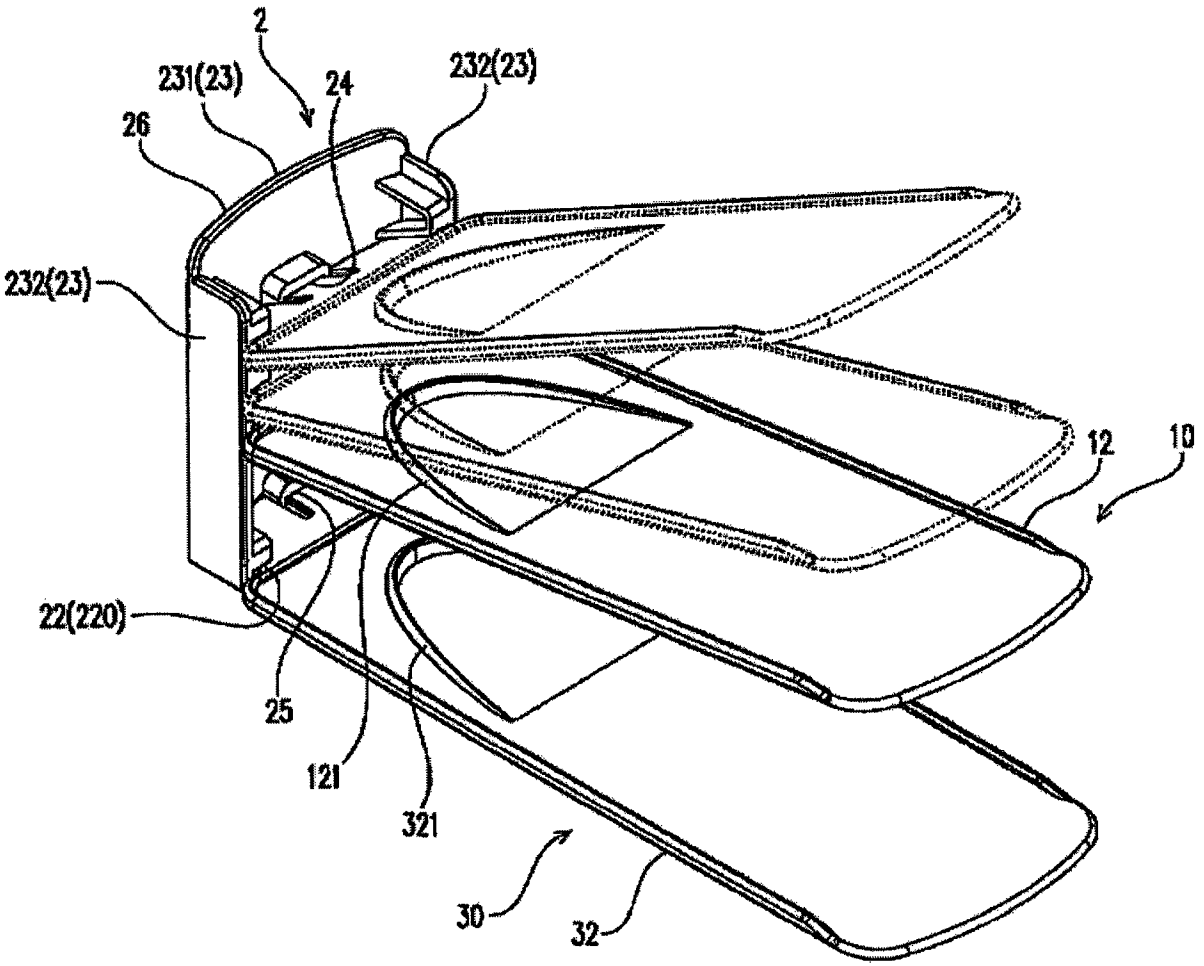
FIG. 5 is a schematic perspective view of the shoe storage apparatus according to the same embodiment, showing the shoe storage apparatus in a state where the upper panel is attached to the leg.

The plurality of pairs of upper panel support portions 21 are arranged in parallel vertically as shown in FIG. 1, FIG. 4, and FIG. 5. Accordingly, each of the plurality of pairs of upper panel support portions 21 can support the upper panel 10 at various heights. Each of these upper panel support portions 21 has an upper groove 210 extending in a direction crossing the vertical direction so as to enable the leg 20 to support the upper panel 10 in a cantilever manner. The upper grooves 210 are connected to each of the second standing portions 232 and 232, and one ends thereof in the depth direction are constituted to be opened, and accordingly, the upper grooves 210 can support both end portions in the width direction of the upper panel 10 inserted from the opened one ends. A pair of upper panel support portions 21 disposed at higher positions has upper grooves 210 of which inclinations in the depth direction with respect to the horizontal direction are larger than those of a pair of upper panel support portions 21 disposed at lower positions. Accordingly, the plurality of pairs of upper panel support portions 21 are constituted so that each pair of upper panel support portions 21 can support the base end portion of the upper panel 10 in such a manner that the upper panel 10 inclines upward from the base end portion toward the tip end portion, and the inclination angle of the upper panel 10 is made larger by supporting the base end portion of the upper panel 10 by a pair of upper panel support portions 21 located at positions higher than a pair of upper panel support portions 21 located at lower positions.

The upper attaching portions 24 are provided at the central portion in the width direction of the leg 20 in accordance with the inclinations of the upper grooves 210 of the plurality of pairs of upper panel support portions 21. The plurality of upper attaching portions 24 are provided so as to correspond to the respective pairs of upper panel support portions 21 one to one.

As shown in FIG. 4, the lower panel support portions 22 have lower grooves 220 extending along the upper surface of the installation portion, and support the lower panel 30 in the lower grooves 220, so that the lower panel 30 can be supported in a direction along the installation surface. The lower attaching portion 25 is constituted so as to be connected to a surface of the first standing portion 231 continuous to the upper surface of the installation portion in accordance with the positions of the bottoms of the lower grooves 220 so that lower panel 30 can be inserted.

As shown in FIG. 2, the upper panel 10 has a projecting piece-shaped upper supported portion 11 on the base end portion. Further, the upper panel 10 has an upper placing portion 12 on which either one shoe of a pair of shoes can be placed. The upper panel 10 is detachable from the leg 20.

The upper supported portion 11 has an upper inserting portion 111 that extends from the upper placing portion 12 and is inserted into the upper attaching portion 24, and an upper extending portion 110 that extends from the upper placing portion 12 to each of the both sides of the upper inserting portion 111.

The upper inserting portion 111 is formed in a flat plate shape with the same thickness as that of the upper extending portion 110, and extends in the same direction as the extending direction of the upper extending portion 110 from the central portion in the width direction of the upper extending portion 110. The upper inserting portion 111 is extended to be longer than the extending direction length of both end portions in the width direction of the upper extending portion 110, and constituted so as to be able to be inserted into the leg 20. The upper inserting portion 111 has an upper projecting portion 113 projecting from the upper surface, and the upper projecting portion 113 is latched on the leg 20, and thereby the upper panel 10 is prevented from falling off the leg 20.

The upper extending portion 110 is formed in a flat plate shape, and extends with a width narrower than the width of the upper placing portion 12 from the upper placing portion 12. The upper extending portion 110 extends with a length enabling the leg 20 to support the upper placing portion 12 from the upper placing portion 12. In the present embodiment, the upper extending portion 110 is formed to have the same thickness as that of the upper placing portion 12.

The upper placing portion 12 is formed in a flat plate shape with a size on the upper surface of which either one shoe of a pair of shoes can be placed. In the present embodiment, the upper placing portion 12 is formed in a plate and square shape (rectangular shape) in a plan view, and has a size on the upper surface of which either one shoe of a pair of shoes can be placed. In the present embodiment, the upper placing portion 12 has an upper salient portion 121 projecting in the thickness direction from the upper surface at a predetermined position, and the upper salient portion 121 is formed in an arc shape in a plan view so that the outer edge of the heel of a shoe is latched thereon. Accordingly, the upper salient portion 121 is able to regulate the movement of either one shoe placed thereon of a pair of shoes so as to prevent the shoe placed thereon from moving from the placed position.

Figure 3:
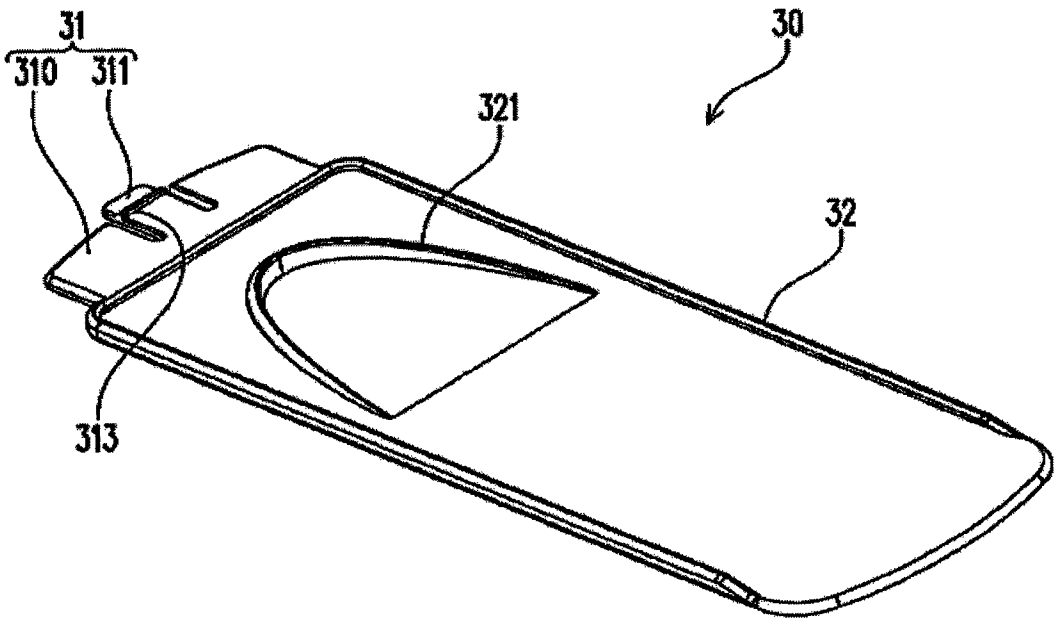
FIG. 3 is a schematic perspective view of the lower panel according to the same embodiment.

As shown in FIG. 3, the lower panel 30 has a projecting piece-shaped lower supported portion 31 on the base end portion. The lower panel 30 has a lower placing portion 32 on which the other shoe of the pair of shoes can be placed.

The lower supported portion 31 has a lower inserting portion 311 that extends from the lower placing portion 32 and is inserted into the lower attaching portion 25, and a lower extending portion 310 extending from the lower placing portion 32 to both sides of the lower inserting portion 311.

The lower extending portion 310 is formed in a flat plate shape and extends with a width narrower than the width of the lower placing portion 32 from the lower placing portion 32. The lower extending portion 310 extends with a length enabling the leg 20 to support the lower placing portion 32 from the lower placing portion 32. In the present embodiment, the lower extending portion 310 is formed to have the same thickness as that of the lower placing portion 32.

The lower inserting portion 311 is formed in a flat plate shape with the same thickness as that of the lower extending portion 310, and extends in the same direction as the extending direction of the lower extending portion 310 from the central portion in the width direction of the lower extending portion 310. The lower inserting portion 311 is extended to be longer than the extending direction length of both end portions in the width direction of the lower extending portion 310, and constituted so as to be able to be inserted into the leg 20. The lower inserting portion 311 has a lower projecting portion 313 projecting from the upper surface, and the lower projecting portion 313 is latched on the leg 20, and thereby the lower panel 30 is prevented from falling off the leg 20.

The lower placing portion 32 is formed in a flat plate shape with a size on the upper surface of which the other shoe of the pair of shoes can be placed. In the present embodiment, the lower placing portion 32 is formed in a plate and square shape (rectangular shape) in a plan view, and has a size on the upper surface of which the other shoe of the pair of shoes can be placed. In the present embodiment, the lower placing portion 32 has a lower salient portion 321 projecting in the thickness direction from the upper surface at a predetermined position, and the lower salient portion 321 is formed in an arc shape in a plan view so that the outer edge of the toe of the shoe is latched thereon. Accordingly, the lower salient portion 321 is able to regulate the movement of the other shoe placed thereon of the pair of shoes so as to prevent the other shoe placed thereon from moving from the placed position. The heel of one shoe of the pair of shoes is latched on the upper salient portion 121, and the toe of the other shoe of the pair of shoes is latched on the lower salient portion 321, so that the heel portions that are the highest portions of the shoes are disposed alternately, and thereby, the storage space can be effectively utilized.

The shoe storage apparatus 1 according to the present embodiment is constituted as described above, and next, operation of the shoe storage apparatus 1 according to the present embodiment is described below.

First, when storing shoes, the upper panel 10 and the lower panel 30 are attached to the leg 20. Specifically, both end portions in the width direction of the lower extending portion 310 of the lower panel 30 are inserted into the lower grooves 220, and the lower inserting portion 311 is inserted into the lower attaching portion 25. Then, the lower projecting portion 313 is latched on the lower attaching portion 25 by the weight of the lower panel 30, and thereby, the lower panel 30 is supported by the leg 20.

Then, the upper panel 10 is attached to the leg 20. Specifically, according to the height of the shoes to be stored, a pair of upper panel support portions 21 to support the upper panel 10 is selected among the plurality of pairs of upper panel support portions 21. Then, both end portions in the width direction of the upper extending portion 110 are inserted into the upper grooves 210 of the selected pair of upper panel support portions 21, and the upper inserting portion 111 is inserted into the upper attaching portion 24. Then, the upper projecting portion 113 is latched on the upper attaching portion 24 by the weight of the upper panel 10, and thereby, the upper panel 10 is supported by the leg 20.

Either one shoe of a pair of shoes is placed on the upper panel 10 of the shoe storage apparatus 1 in which the upper panel 10 and the lower panel 30 are attached to the leg 20 as described above, and the other shoe of the pair of shoes is placed on the lower panel 30. Then, the one shoe of the pair of shoes is latched so that the heel of which fits to the upper salient portion 121 of the upper panel 10, and the other shoe of the pair of shoes is latched so that the toe of which fits to the lower salient portion 321 of the lower panel 30, and thereby, each of the left and right shoes of the pair of shoes is restricted from moving on the upper panel 10 or the lower panel 30. Accordingly, the left and right shoes of the pair of shoes are disposed one above the other. It makes possible to effectively utilize a space by storing the shoe storage apparatus 1 on which the shoes are thus placed, as compared with the case where the shoes are arranged laterally side-by-side.

On the other hand, the shoes are taken out from the state where the pair of shoes is placed on the lower panel 30 and the upper panel 10, respectively. Then, the upper panel 10 and the lower panel 30 are removed from the leg 20 in order to store the shoe storage apparatus 1. Specifically, the upper panel 10 is removed from the leg 20 by releasing latching of the upper projecting portion 113 and the upper attaching portion 24, pulling out the upper inserting portion 111 from the upper attaching portion 24, and pulling out both end portions in the width direction of the upper extending portion 110 from the upper grooves 210. The lower panel 30 is removed from the leg 20 by releasing latching of the lower projecting portion 313 and the lower attaching portion 25, pulling out the lower inserting portion 311 from the lower attaching portion 25, and then pulling out both end portions in the width direction of the lower extending portion 310 from the lower grooves 220. Thus, the space for storing the shoe storage apparatus 1 can be saved by separating the leg 20, the upper panel 10, and the lower panel 30 from each other.

As described above, the shoe storage apparatus 1 according to the present embodiment has the leg 20 to be disposed on an installation surface, and an upper panel 10 which has a base end portion to be supported by the leg 20 and a tip end portion on the side opposite to the base end portion, and is disposed at a distance from the installation surface in a state where the base end portion is supported by the leg 20, and on which one shoe of a pair of shoes can be placed, and the upper panel 10 is constituted to be detachable from the leg 20.

With this constitution, when storing shoes, either one shoe of a pair of shoes is placed on the upper panel 10, and the other shoe of the pair of shoes is disposed below the upper panel 10, and thereby, the left and right shoes of the pair of shoes can be stored as arranged one above the other. Therefore, when storing a pair of shoes by using the shoe storage apparatus 1 constituted as described above, a space in the vertical direction can be effectively utilized as compared with the case where the pair of shoes are stored as arranged laterally side-by-side.

In addition, the above-described shoe storage apparatus 1 is constituted so that the upper panel 10 is detachable from the leg 20, and accordingly when the shoe storage apparatus 1 is not used, the upper panel 10 and the leg 20 can be separated from each other. Therefore, when the shoe storage apparatus 1 is not used, the upper panel 10 is not in a state of extending from the leg 20, so that it does not occupy a space needlessly. Accordingly, the occupied space of the shoe storage apparatus 1 when not in use (when stored) can be reduced.

As an aspect of the shoe storage apparatus 1 according to the present embodiment, the leg 20 may include a plurality of pairs of upper panel support portions 21 each of which can support the base end portion of the upper panel 10, and the plurality of pairs of upper panel support portions 21 may be arranged in parallel vertically.

With this constitution, the base end portion of the upper panel 10 is supported by any pair of the plurality of pairs of upper panel support portions 21, and thereby the upper panel 10 can be disposed at a position corresponding to the height of the shoes. Accordingly, the shoe storage apparatus 1 can store not only shoes with specific heights but also shoes with various heights.

As another aspect of the shoe storage apparatus 1 according to the present embodiment, preferably, the plurality of pairs of upper panel support portions 21 are constituted so that each pair of upper panel support portions 21 can support the base end portion of the upper panel 10 in such a manner that the upper panel 10 inclines upward from the base end portion toward the tip end portion, and the inclination angle of the upper panel 10 is made larger by supporting the base end portion of the upper panel 10 by a pair of upper panel support portions 21 located at positions higher than a pair of upper panel support portions 21 located at lower positions.

With this constitution, the upper panel 10 is supported by a pair of upper panel support portions 21 located at higher positions and thereby inclines at an inclination angle (an angle with respect to the installation surface) larger than that in the case where the upper panel 10 is supported by a pair of upper panel support portions 21 located at lower positions. Accordingly, the tip end portion side of the upper panel 10 is positioned to be higher than the base end portion, and it allows widening the space below the tip end portion of the upper panel 10. Therefore, even a high-heeled or high-cut shoe can be disposed not only on the upper panel 10 but also below the upper panel 10.

As another aspect of the shoe storage apparatus 1 according to the present embodiment, the shoe storage apparatus 1 may be constituted so as to further include a lower panel 30 that has a base end portion to be supported by the leg 20 and a tip end portion on the side opposite to the base end portion, and is disposed along the installation surface in a state where the base end portion is supported by the leg 20, and the lower panel 30 may be constituted to be detachable from the leg 20.

With this constitution, after one (the other) shoe of a pair of shoes is placed on the upper panel 10 and the other (one) shoe of the pair of shoes is placed on the lower panel 30, the shoe storage apparatus 1 is stored, and accordingly, the pair of shoes can be stored, so that the shoes can be more easily stored. By disposing a shoe on the lower panel 30, even if dirt adheres to the shoe bottom, the dirt on the shoe bottom can be prevented from adhering to the installation surface (for example, installation surface inside a shoe box).

As another aspect of the shoe storage apparatus 1 according to the present embodiment, the leg 20 may be provided with a pair of lower panel support portions 22 capable of supporting the base end portion of the lower panel 30.

With this constitution, the lower panel 30 is supported by the pair of lower panel support portions 22 and thereby is appropriately attached to the position along the installation surface.

As another aspect of the shoe storage apparatus 1 according to the present embodiment, the upper panel 10 may have a projecting piece-shaped upper supported portion 11 on the base end portion, and the leg 20 may have, at positions corresponding to the pairs of upper panel support portions 21, upper attaching portions 24 into which the upper supported portion 11 can be inserted and which can prevent the upper supported portion 11 from coming off.

With this constitution, by inserting the upper supported portion 11 into the upper attaching portion 24, the upper panel 10 is latched on the inner surface of the upper attaching portion 24 by its own weight. Accordingly, the upper panel 10 is prevented from coming off by the upper attaching portion 24, so that the upper panel 10 can be prevented from falling off the leg 20 unexpectedly.

As another aspect of the shoe storage apparatus 1 according to the present embodiment, the lower panel 30 may have a projecting piece-shaped lower supported portion on the base end portion, and the leg 20 may have, at a position corresponding to the pair of lower panel support portions, a lower attaching portion 25 into which the lower supported portion 31 can be inserted and which can prevent the lower supported portion 31 from coming off.

With this constitution, by inserting the lower supported portion 31 into the lower attaching portion 25, the lower panel 30 is latched on the inner surface of the lower attaching portion 25 by its own weight. Accordingly, the lower panel 30 is prevented from coming off by the lower attaching portion 25, so that the lower panel 30 can be prevented from falling off the leg 20 unexpectedly.

The shoe storage apparatus according to the present invention is not limited to the above-described embodiment, and as a matter of course, can be variously modified without departing from the spirit of the present invention. It is a matter of course that the constitutions, methods, etc., relating to various modifications described below may be arbitrarily selected and used as the constitutions, methods, etc., relating to the above-described embodiment.

For example, the shoe storage apparatus 1 according to the above-described embodiment includes the lower panel 30, however, it can be constituted without including the lower panel 30. In this case, by disposing one shoe of a pair of shoes below the upper panel 10, the shoe storage apparatus 1 can be stored in a shoe box. In this case, the placing portion consists of an installation area in which the leg 20 supporting the upper panel 10 on which one shoe of a pair of shoes is placed can be stood up.

In the shoe storage apparatus 1 according to the above-described embodiment, the lower panel 30 is detachable from the leg 20. However, without being limited by this, the lower panel 30 may be constituted so as not to be detached from the leg 20 as a matter of course.

The shoe storage apparatus 1 according to the above-described embodiment has the upper salient portion 121 or the lower salient portion 321 formed according to the shapes of the heels of the shoes, however, the upper salient portion 121 or the lower salient portion 321 may be omitted. Instead of the upper salient portion 121 or the lower salient portion 321, a plurality of projections (not shown) may be provided on the upper surface of the upper placing portion 12 or the lower placing portion 32. Specifically, the upper salient portion 121 or the lower salient portion 321 may be replaced with projections (not shown) that are provided across the entire upper surface of the upper placing portion 12 or the lower placing portion 32. Accordingly, the upper salient portion 121 or the lower salient portion 321 functions for preventing slipping of a shoe placed on the upper placing portion 12 or the lower placing portion 32.

1 Shoe storage apparatus
10 Upper panel
11 Upper supported portion
12 Upper placing portion
20 Leg
21 Upper panel support portion
22 Lower panel support portion
23 Standing portion
24 Upper attaching portion
25 Lower attaching portion
30 Lower panel
31 Lower supported portion
32 Lower placing portion
110 Upper extending portion
111 Upper inserting portion
113 Upper projecting portion
121 Upper salient portion
210 Upper groove
231 First standing portion
232 Second standing portion
310 Lower extending portion
311 Lower inserting portion
313 Lower projecting portion
321 Lower salient portion

What is claimed is:

1. A shoe storage apparatus comprising:

a leg to be disposed on an installation surface; and an upper panel which has a base end portion to be supported by the leg and a tip end portion on the side opposite to the base end portion and which is disposed at a distance from the installation surface in a state where the base end portion is supported by the leg and capable of placing one shoe of a pair of shoes thereon, wherein the upper panel is constituted to be detachable from the leg when the shoe storage apparatus is not in use, wherein the leg includes a plurality of pairs of upper panel support portions to support upper panel in a cantilever manner where each of these upper panel support portions has an upper groove extending in a direction crossing the vertical direction so as to enable the leg to support both end portions of base end of the upper panel in the width direction, and the plurality of pairs of upper panel support portions are arranged in parallel vertically, and wherein said upper grooves of the plurality of pairs of upper panel support portions are constituted so that each pair of upper panel support portions can support the base end portion of the upper panel in such a manner that the upper panel inclines upward from the base end portion toward the tip end portion, and the inclination angle of the upper panel is made larger by supporting the base end portion of the upper panel by a pair of upper panel support portions located at positions higher than a pair of upper panel support portions located at lower positions;

wherein the upper panel has a projecting piece-shaped upper supported portion on the base end portion, and the leg has in the central portion in the width direction of the leg at positions corresponding to the pairs of upper panel support portions, upper attaching portions into which the upper supported portion can be inserted and which can prevent the upper supported portion from corning off.

2. The shoe storage apparatus according to claim 1, further comprising a lower panel that has a base end portion to be supported by the leg and a tip end portion on the side opposite to the base end portion, and is disposed along an installation surface in the state where the base end portion is supported by the leg, wherein the lower panel is constituted to be detachable from the leg when the shoe storage is not in use.

3. The shoe storage apparatus according to claim 2, wherein the upper panel has a projecting piece-shaped upper supported portion on the base end portion, and the leg has, at positions corresponding to the pairs of upper panel support portions, upper attaching portions into which the upper supported portion can be inserted and which can prevent the upper supported portion from coming off.

4. The shoe storage apparatus according to claim 2, wherein the lower panel has a projecting piece-shaped lower supported portion on the base end portion, and the leg has, at a position corresponding to the pair of lower panel support portions, a lower attaching portion into which the lower supported portion can be inserted and which can prevent the lower supported portion from coming off.

* * * * *